US007857175B2

(12) United States Patent
Schorr

(10) Patent No.: US 7,857,175 B2
(45) Date of Patent: Dec. 28, 2010

(54) BOW-MAKING ASSIST DEVICE WITH STORAGE

(76) Inventor: Natalie E. Schorr, 113 Masterpoint, Broussard, LA (US) 70518

( * ) Notice: Subject to any disclaimer, the term of this patent is extended or adjusted under 35 U.S.C. 154(b) by 811 days.

(21) Appl. No.: 11/742,727

(22) Filed: May 1, 2007

(65) Prior Publication Data

US 2008/0000934 A1 Jan. 3, 2008

Related U.S. Application Data

(60) Provisional application No. 60/806,465, filed on Jul. 1, 2006.

(51) Int. Cl.
*A41H 23/00* (2006.01)

(52) U.S. Cl. ..... 223/46; 223/44

(58) Field of Classification Search ..... 223/44, 223/46; 28/147, 149, 150; 428/4
See application file for complete search history.

(56) References Cited

U.S. PATENT DOCUMENTS 2,679,341 A * 5/1954 Tinker ..... 223/107
2,846,284 A * 8/1958 Fitzgerald ..... 312/119
3,300,107 A * 1/1967 Koch ..... 223/46
4,410,113 A 10/1983 Palombo
4,714,182 A * 12/1987 Hecht ..... 223/46
5,356,056 A * 10/1994 Teuten ..... 223/46
5,411,188 A * 5/1995 Teuten ..... 223/46
5,509,586 A 4/1996 Leiser
5,617,979 A 4/1997 Cavender
5,662,250 A 9/1997 Werling
5,810,214 A * 9/1998 Hecht ..... 223/46
6,000,586 A * 12/1999 Cavender ..... 223/46
6,131,778 A 10/2000 Etzion
6,296,366 B1 * 10/2001 Hopps ..... 362/154
6,691,903 B2 * 2/2004 West, Sr. ..... 223/46

* cited by examiner

*Primary Examiner*—Shaun R Hurley
*Assistant Examiner*—Andrew W Sutton

(57) ABSTRACT

An uncomplicated, easy-to-use, and non-mechanical device for making loop-fashioned bows from wraphia, curling, or other similarly flexible ribbon. The rectangular box configuration serves a three-fold purpose. First, the two horizontally-placed dowel-like rods act as the "hands" by which the ribbon is held taut. Secondly, spools of ribbon can be supported by four vertically-placed dowel-like rods located on the top surface, giving the bow-maker various ribbon color options while keeping the spools contained in an easy-to-work-with space. Finally, an added feature is the pull-out drawer which will allow for storage of various bow-making and gift-wrapping supplies, including the various dowel-like rods. This allows for easy and compact storage when the device is not in use.

2 Claims, 4 Drawing Sheets

BOW-MAKING ASSIST DEVICE WITH STORAGE

I claim priority of Provisional Application No. 60/806,465 filed on Jul. 1, 2006.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

BACKGROUND OF THE INVENTION

Field of Invention

This invention relates to the making of decorative, loose, loop-fashioned bows out of wraphia, curling, or other similarly flexible ribbon and a device which will assist ONE person in making said bow.

BRIEF SUMMARY OF THE INVENTION

When making a bow with wraphia, curling, or other similar ribbon, it is difficult for one person to manipulate the ribbon in order to make a beautiful bow. One typically has to seek the assistance of another person (Person #2) to hold out their hands while Person #1 circulates the ribbon around and around their hands. Person #2's thumbs would hold down the loose ends of the ribbon. With the "Bow-making Assist Device with Storage", the two horizontally-placed dowel-like rods located on the anterior of the "box" act as the "hands" by which the ribbon is circulated around and around to form the loops of the bow. The grommet-like grooves, which are positioned around the dowel-like rods, hold the loose ribbon ends in place. These two horizontally-placed dowel-like rods are adjustable and moveable which allow for varying sizes of bows to be made. Therefore, a beautiful bow can be formed by only one person utilizing the "Bow-making Assist Device with Storage".

Furthermore, the ability to have one or more (up to eight) spools of ribbon secured on four vertically-placed dowel-like rods allows the user to keep the spools of ribbon contained while working to create the bow. Many times, when trying to make a bow, the spools of ribbon become tangled up or fall to the floor while pulling the desired amount of ribbon. This is cumbersome and problematic. Having the spools of ribbon contained and accessible allows the process to be easy and enjoyable.

It is important to note that the type of narrow, light-weight ribbon used with this "Bow-making Assist Device with Storage" does not typically lay flat and therefore the two horizontally-placed dowel-like rods which act as the "hands" keep the ribbon taut and is thus a key in the utility and usefulness of this device.

The "Bow-making Assist Device with Storage" is extremely useful in my own home and in my own experiences. I have also been able to use the "Bow-making Assist Device with Storage" to create unique and different bows which are of my own design creation.

Referring to David Hecht's U.S. Pat. No 5,810,214 entitled METHOD AND DEVICE FOR BOW-MAKING issued on Sep. 22, 1998, he describes in the "Background of Invention" the difficulties encountered when untrained persons attempt to make bows without any assistive device. In addition, it is well described how some patented devices are cumbersome and difficult to use.

Furthermore, it is important to note that the type of bow that is produced with the "Bow-making Assist Device with Storage" is not the same as is described with several other patented devices. Other differences exist as well, such as:

1. John M. Werling; U.S. Pat. No. 5,662,250 entitled BOW-FORMING DEVICE issued on Sep. 2, 1997. This particular device calls for a "weaving pattern" and requires the cinching to be with wires or staples. Furthermore, the end result is NOT the same type of bow that one would make with the "Bow-making Assist Device with Storage".
2. Craig Teuten's U.S. Pat. No. 5,356,056 entitled ADJUSTABLE BOW MAKING DEVICE FORM issued on Oct. 18, 1994. A key difference is that the "rods" are vertical whereas with the "Bow-making Assist Device with Storage", the dowel-like rods are placed horizontally, which holds the ribbon taut and allows for easier manipulation of the ribbon, thus the ribbon does not get tangled on itself. Again, the type of bows produced are different, in that the "Bow-making Assist Device with Storage" produces a loose, free-form type bow as opposed to a rigid bow.
3. David Hecht's U.S. Pat. No. 5,810,214 issued on Sep. 22, 1998 entitled METHOD AND DEVICE FOR BOW MAKING. Again, this particular device differs from the "Bow-making Assist Device with Storage" because of the vertically placed rods. When working with several strands of ribbon, I believe that this device, too, would be cumbersome and that the ribbon could become more easily tangled, and therefore making the bow-making process difficult.
4. Mary A. Leiser's U.S. Pat. No. 5,509,586 entitled BOW MAKING FORM issued on Apr. 23,1996. The making of this bow relies on a "form" which becomes a permanent part of the bow, unless the bow is disassembled so that the "form" may be used again.

To highlight the differences between other bow-making assistive devices and the "Bow-making Assist Device with Storage":

1. The two horizontally-placed dowel-like rods with the grommet grooves are critical in keeping the ribbon taut and the loose-ends secure; (the ribbon does not get tangled in the process);
2. The type of bow-produced with the "Bow-making Assist Device with Storage" is NOT rigid but rather a loose, free-form type bow;
3. The spools of ribbon are secured on the top of the box, supported by four vertically-placed dowel-like rods, which allows the ribbon to be up and out of the way while working to make the decorative bow. This is an added feature that is a real asset for the bow-maker;
4. No wires, staples, or permanent "forms" are required;
5. As an added feature, a pull-out drawer is available to provide storage for miscellaneous gift-wrapping and bow-making tools. Even the dowel-like rods may be stored inside so that when the device is not in use, it can be stored away without using much space.

DETAILED DESCRIPTION OF INVENTION

Figure 1:
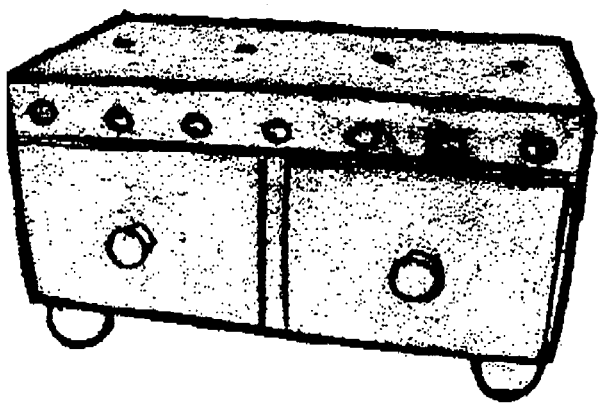
FIG. 1 illustrates a perspective view of the anterior of the "Bow-making Assist Device with Storage" is shown with all components and tools stored inside the pull-out drawer.
Figure 2:
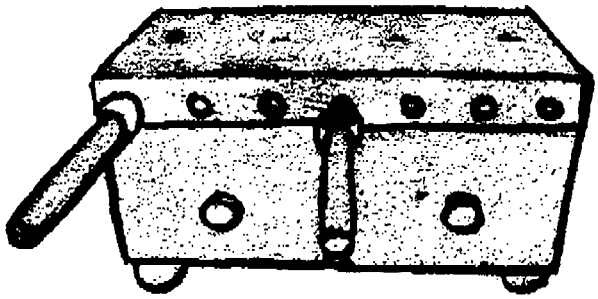
FIG. 2 illustrates a perspective view of the anterior of the "Bow-making Assist Device with Storage" is shown with the two horizontally-placed dowel-like rods that act as the "hands" by which the ribbon is kept taut.
Figure 3:
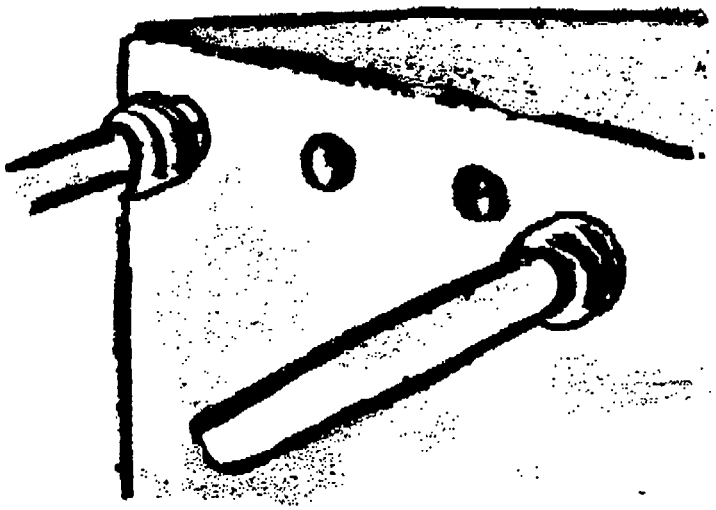
FIG. 3 illustrates a perspective view of a close-up view of the "Bow-making Assist Device with Storage" showing the grommet grooves which hold the loose ribbon ends in place.
Figure 4:
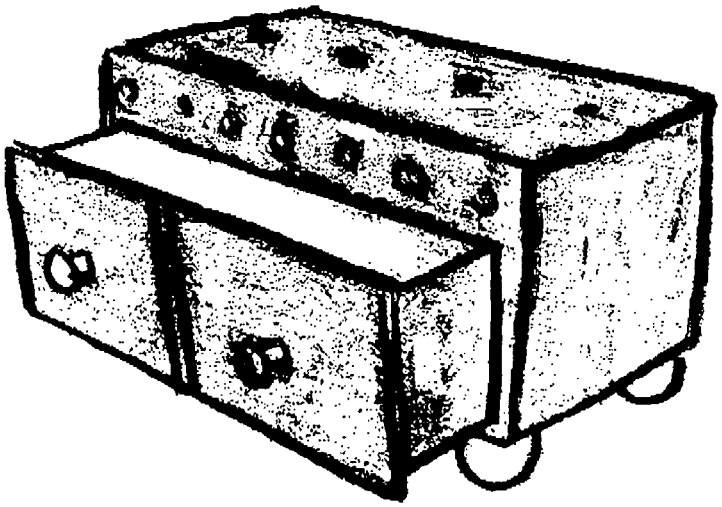
FIG. 4 illustrates a perspective view of the side view of the "Bow-making Assist Device with Storage" shown with the drawer open.
Figure 5:
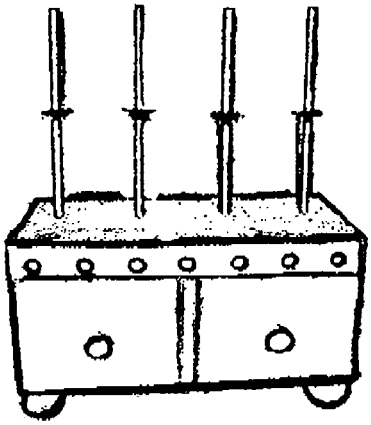
FIG. 5 illustrates a perspective view of the "Bow-making Assist Device with Storage" with the four vertically-placed dowel-like rods which hold up to eight spools of ribbon. The upper most tiers of spools are supported by a circular disc.
Figure 6:
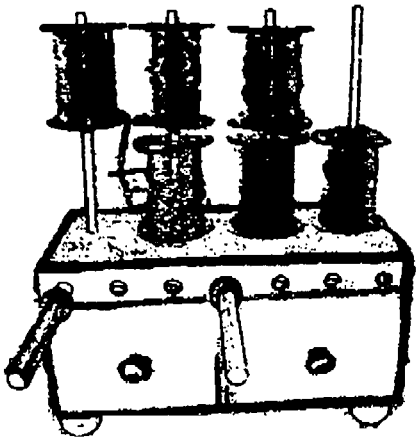
FIG. 6 illustrates a perspective view of the "Bow-making Assist Device with Storage" with spools of ribbon supported on the four vertically-placed dowel-like rods.
Figure 7:
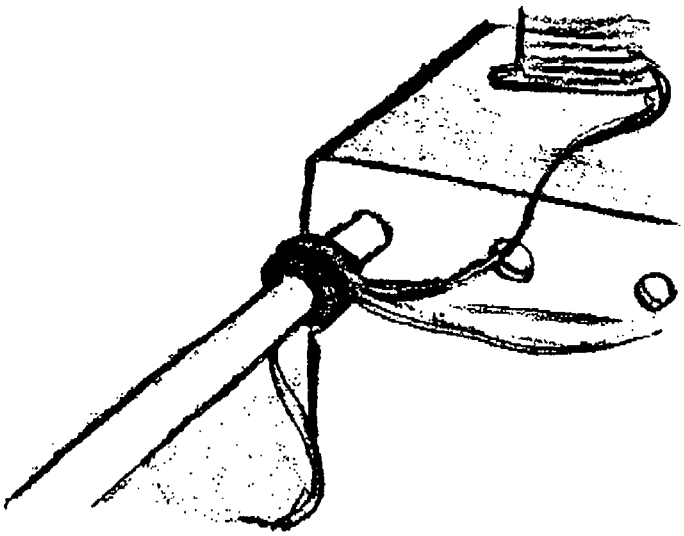
FIG. 7 illustrate a perspective view of a close-up view of how the loose ribbon end is securely held in place by the grommet groove.
Figure 8:
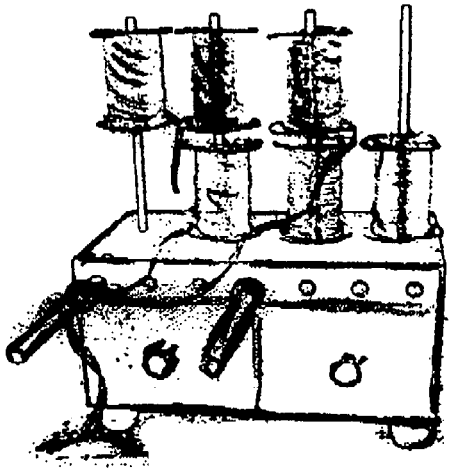
FIG. 8 illustrates a perspective view of the "Bow-making Assist Device with Storage" with spools of ribbon in place and the loose ends of the ribbon being held securely by the grommet groove.
Figure 9:
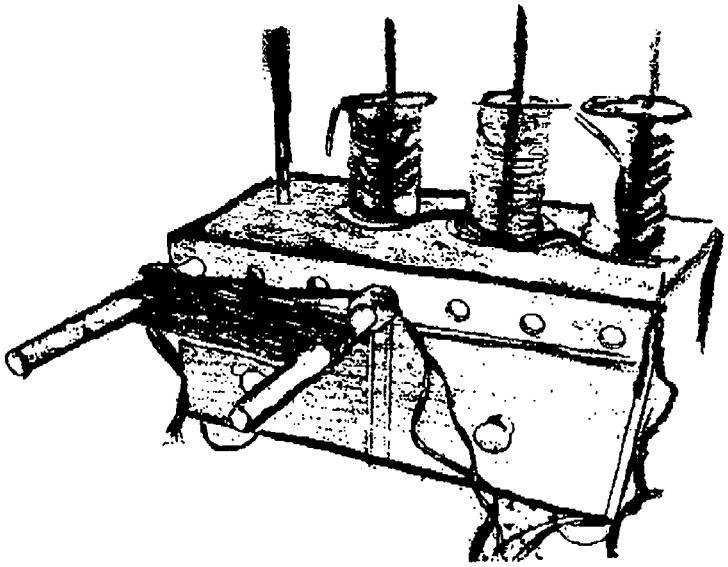
FIG. 9 illustrates a perspective view of the "Bow-making Assist Device with Storage" shown in a close-up view of how the ribbon is looped around and around the two horizontally-placed dowel-like rods, forming the loops of the bow. The loose ribbon ends are secured in place by the grommet groove.
Figure 10:
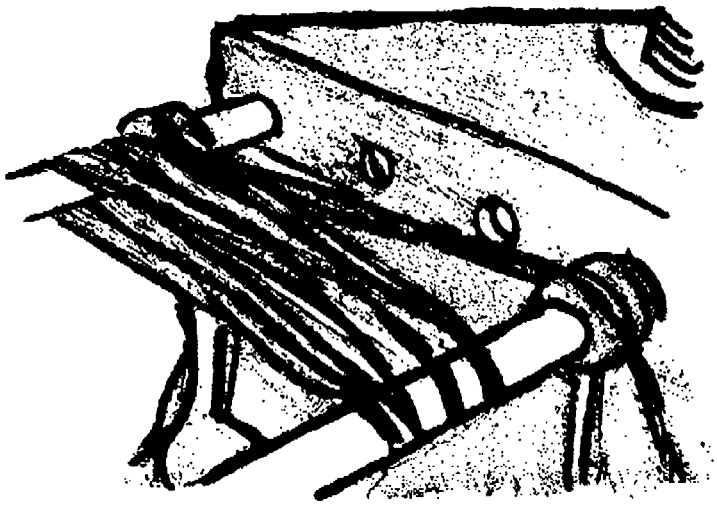
FIG. 10 illustrates a perspective view of extreme close-up view of FIG. 9.
Figure 11:
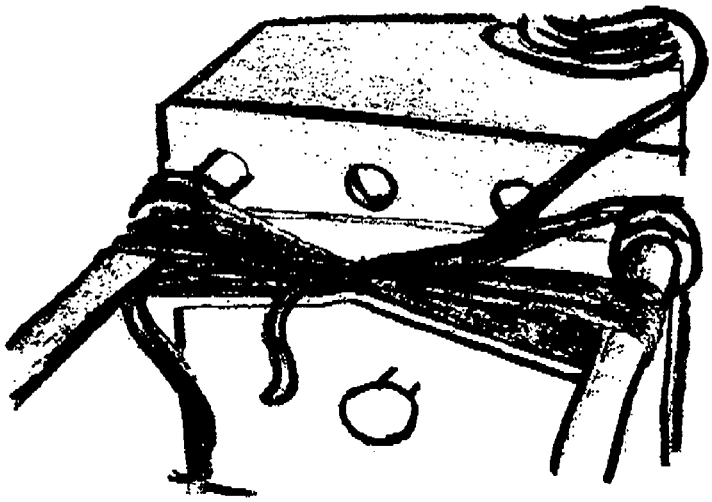
FIG. 11 illustrates a perspective view of a close-up view of how the bow is knotted in the center and ready to be slid off of the two horizontally-placed dowel-like rods.
Figure 12:
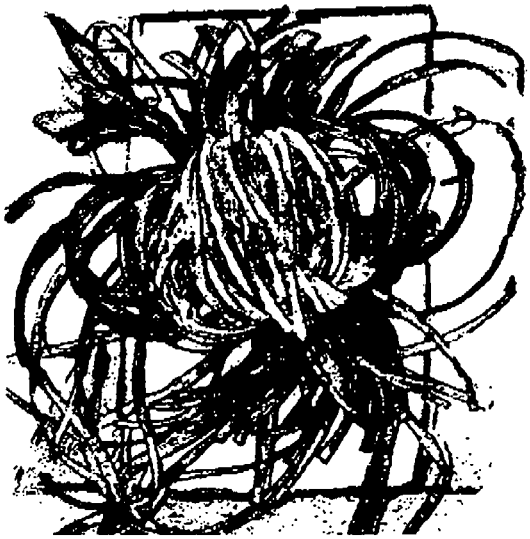
FIG. 12 illustrates a perspective view of an example of my very own unique bow design that can be made using the "Bow-making Assist Device with Storage".

The "Bow-making Assist Device with Storage" is described as a rectangular-shaped box configuration with a pull-out drawer for storage of miscellaneous gift-wrapping and bow-making tools along with four dowel-like rods which hold and support one to eight spools of ribbon (a cut-out hole is located on the top surface of the "Bow-making Assist Device with Storage" which the dowel-like rods fit in to; each dowel-like rod measures 11 inches in length and approximately ¼ inch in diameter) and two other removable and re-positionable dowel-like rods which serve as the "hands" by which the bow is made. (These dowel-like rods are 10 inches in length and approximately ½ inch in diameter. The dowel-like rods are moveable and repositionable so that the bow-maker can create varying sizes of bows, ranging from approximately two inches to approximately twelve inches.)

The dowel-like rods which hold and support the spools of ribbon are located on the top surface of the "box" while the two removable and re-positionable dowel-like rods are located on the anterior surface of the "box" and are manually movable to varying positions which allows for varying bow sizes.

The dimensions of the "Bow-making Assist Device with Storage" are 14 inches in width, 8 5/16 inches in height, and 7 9/16 inches in depth. (In production, the dimensions may be modified, if necessary.) The seven holes shown on the anterior surface are for the placement of the horizontally-placed dowel-like rods. The four holes shown on the top surface of the box are for the dowel-like rods which support the spools of ribbon.

An added feature of the "Bow-making Assist Device with Storage" is that once one has completed their bow-making, the "Bow-making Assist Device with Storage" can be easily stored away and all the tools and dowel-like rods stored neatly inside the pull-out drawer.

The "Bow-making Assist Device with Storage" is shown in these drawings as un-painted raw wood. Various aesthetic changes to the device may be introduced to enhance the marketability of the product without distracting from the invention. These changes may comprise one or more of the following materials: wood, plastic, rubber, metal, or any other material deemed effective by the inventor. In addition, the product will likely be very brightly colored and the grommet grooves would likely be colorful rubberized grommets or similar material.

Unlike other patented bow-making devices, the "Bow-making Assist Device with Storage" is uncomplicated and non-mechanical, and, it adds two extra necessary elements . . . a place for the spools of ribbon to reside while working to create the bow, and two, the convenience of storing tools and supplies, including the dowel-like rods. The "Bow-making Assist Device with Storage" is specifically utilized for a wraphia, curling, or similar type ribbon. The key with using this type of flexible ribbon is that it must remain taut and that is how the "hands" or two horizontally placed dowel-like rods located on the anterior of the "box" aid the bow-maker in creating beautiful bows. Therefore, a patent is being sought on the usefulness of this device in allowing one person to create bows for decorative purposes, even though many creative possibilities exist with the type of bow one may create using the "Bow-making Assist Device with Storage".

The embodiments of this invention in which an exclusive property or privilege is claimed are defined as follows:

1. A manual bow-making assistive device with storage drawer comprising a flat superior surface, a flat inferior surface, two flat lateral side surfaces, an anterior surface, and a flat posterior surface, thus configuring the shape of a rectangular box in which a manual bow-making assistive device with storage drawer further comprising an anterior surface to which two removable horizontally-placed rods act as the supportive means by which ribbon is held taut and circulated to form said bow; furthermore, the two removable horizontally-placed rods may be positioned along the anterior surface of said device by way of removing said horizontal rod and manually moving to an opposing circular opening as to offer the bow-maker an option of varying bow sizes; additionally, the two horizontal rods include a rubberized ring by which ribbon is held securely in place; the anterior surface of said device further comprises a manual pull-out drawer to which various tools for gift-wrapping and ribbon-making may be stored.

2. As stated in claim 1, a manual bow-making assistive device with storage drawer further comprising a flat superior surface to which four removable vertical rods are placed into circular openings as a means to support spools of ribbon; said vertical rods further comprise a supportive ring so that two spools of ribbon may be placed one on top of the other within the same rod.

* * * * *

UNITED STATES PATENT AND TRADEMARK OFFICE

CERTIFICATE OF CORRECTION

PATENT NO. : 7,857,175 B2
APPLICATION NO. : 11/742727
DATED : December 28, 2010
INVENTOR(S) : Natalie E. Schorr It is certified that error appears in the above-identified patent and that said Letters Patent is hereby corrected as shown below:

The address on the patent should ONLY be:

105 Grand Cypress Creek Drive
Broussard, LA 70518

Signed and Sealed this
Nineteenth Day of April, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,857,175 B2
APPLICATION NO. : 11/742727
DATED : December 28, 2010
INVENTOR(S) : Natalie E. Schorr It is certified that error appears in the above-identified patent and that said Letters Patent is hereby corrected as shown below:

Title Page, Item (76) Inventor, the address on the patent should read:

105 Grand Cypress Creek Drive
Broussard, LA 70518

This certificate supersedes the Certificate of Correction issued April 19, 2011.

Signed and Sealed this
Seventeenth Day of May, 2011

David J. Kappos

David J. Kappos
*Director of the United States Patent and Trademark Office*